United States Patent [19]

Bergman et al.

[11] 4,195,463

[45] Apr. 1, 1980

[54] COIN WRAPPER DISCHARGE ASSEMBLY

[75] Inventors: Charles T. Bergman; Robert L. Zwieg, both of Watertown, Wis.

[73] Assignee: Brandt, Inc., Watertown, Wis.

[21] Appl. No.: 957,900

[22] Filed: Nov. 6, 1978

[51] Int. Cl.[2] ..... B65B 57/12

[52] U.S. Cl. ..... 53/52; 53/54; 53/77; 53/212; 133/1A

[58] Field of Search ..... 53/52, 53, 54, 77, 212, 53/532; 133/1 A

[56] References Cited

U.S. PATENT DOCUMENTS

| | | | |
|---|---|---|---|
| 4,026,089 | 5/1977 | Murakami et al. | 53/212 X |
| 4,089,151 | 5/1978 | Bergman et al. | 53/493 |
| 4,162,598 | 7/1979 | Watanabe et al. | 53/54 |

*Primary Examiner*—Travis S. McGehee

*Attorney, Agent, or Firm*—Quarles & Brady

[57] ABSTRACT

There is disclosed a coin wrapper discharge assembly for use with a coin wrapping apparatus that momentarily stops a coin roll to change its direction, and senses the presence of loose coins. The assembly includes a chute disposed beneath a coin wrapping apparatus that accepts coin rolls falling downwardly after being wrapped. The chute directs a coin roll laterally from its original downward direction into a V-shaped trap. The trap is formed by an inclined floor and a swingable door. A solenoid is provided to hold the door in its normally closed position until actuated by a paper feed mechanism in the coin wrapping apparatus. When actuated, the solenoid releases the door to allow a trapped coin roll to fall onto a conveyor for removal to a packaging point. In addition, the door is electrically insulated from the floor and chute to provide a pair of electrical contacts that are bridged by loose coins to complete an electric circuit that disables the coin wrapping apparatus.

9 Claims, 4 Drawing Figures

COIN WRAPPER DISCHARGE ASSEMBLY

BACKGROUND OF THE INVENTION

This invention relates to coin wrapping apparatuses, and more particularly to a discharge assembly that momentarily stops and changes the direction of a roll of wrapped coins, and detects the presence of loose coins.

Automatic coin wrapping apparatuses are fast becoming the dominant tool for preparing standard coin rolls for different denominations of coins. Fully automatic coin wrapping machines such as that described in U.S. Pat. No. 4,089,151 to Bergman et al for a "Coin Wrapping Machine" issued May 16, 1978, will accept a batch of coins of any particular denomination. This type of machine will automatically form the coins into a stack of predetermined quantity in preparation for wrapping. The coins are then wrapped, and normally discharged downwardly in preparation for wrapping the next stack of coins. The discharged coin rolls must then be removed from the coin wrapping machine to a collection point for packaging. Thus, it is desirable to have a device that will effectively change the direction of a coin roll from a downward movement to a lateral movement for removal from a coin wrapping machine.

If, however, for some unknown reason a coin wrapping apparatus should form either no roll or an incomplete roll of coins, it is desirable to have a device that would catch the loose coins, and upon sensing their presence disable the apparatus and prevent continued wrapping of stacks of coins. It is then desirable to have an operator determine the cause of the problem before further wrapping could take place. An example of a device that detects loose coins and prevents further coin wrapping is shown in U.S. Pat. No. 4,089,151 to Bergman et al issued May 1, 1978. This patent discloses a discharge chute having a floor that has an electrical contact plate which forms a part of the floor, but which is electrically insulated from the remainder of the chute so that the chute and plate form separate switch contacts. When loose coins strike the chute they bridge these contacts to complete an electrical circuit which disables the coin wrapping machine. This type of apparatus, however, allows the coins to continue past the contact area and spill out of the machine.

Accordingly, the present invention provides a coin wrapping apparatus with a device that will effectively change the direction of a wrapped roll of coins as well as catch loose coins, detect their presence, and disable the machine. The device may accommodate coins of all denominations, and is fully automatic.

SUMMARY OF THE INVENTION

The invention resides in a coin roll discharge assembly having a chute disposed beneath a coin wrapping apparatus, a swingable door normally closing the chute to define a trap for a coin roll, release means responsive to the wrapping of a stack of coins for releasably holding the door in its closed position, and sensing means for detecting loose coins in said trap.

A coin wrapping apparatus will normally provide a predetermined number of coins to be vertically stacked in preparation for wrapping. Upon being wrapped, the rolls of coins are discharged by simply dropping them from the apparatus. However, these rolls must also be packaged for ease in handling, and if allowed to simply drop into a container they would be scattered and disorganized resulting in wasted time reorganizing the coin rolls. There is also the possibility that the paper wrapping the coins may burst or tear open upon impact scattering coins all about. Furthermore, if the wrapping apparatus malfunctions and forms either no roll or an incomplete roll of coins, loose coins would become scattered throughout the machine and container before an operator would realize that the wrapping apparatus has malfunctioned. The present invention seeks to solve these problems by providing a discharge assembly that not only traps the dropping coin rolls and realigns them for ease in packaging, but also detects the presence of loose coins and traps them to cause the wrapping apparatus to stop until the loose coins are removed.

In a preferred form, the discharge assembly includes a chute disposed beneath a coin wrapping apparatus comprising a U-shaped elbow having a mouth portion for receiving coin rolls falling downwardly after being wrapped by the coin wrapping apparatus, and a discharge portion that leads to a V-shaped trap. The U-shaped elbow also has side walls that slope downwardly and forwardly towards the discharge portion of the chute to direct a coin roll laterally from its original downward direction into the V-shaped trap. The trap is disposed forward of the discharge portion of the chute, and is formed by an inclined floor and a swingable door. A latching block mounted on the door for movement therewith has a slot formed therein into which a latching pin is extended and retracted by a solenoid to releasably hold the door in its normally closed position. The solenoid is responsive to a cam-operated coin wrapping control to retract the latching pin upon the wrapping of a stack of coins and to extend the latching pin when wrapping is completed. The door is connected to a d-c power source and is electrically insulated from the floor and chute, which are connected to ground, to provide a pair of electrical contacts which are bridged by loose coins to complete an electric circuit to disable the coin wrapping apparatus.

It is an object of the invention to provide a coin wrapper discharge assembly that catches and momentarily stops a coin roll to change its motion from a downward direction to a lateral direction for ease of packaging.

It is also an object of the invention to provide a coin wrapper discharge assembly that detects loose coins in the assembly and disables a coin wrapping apparatus in the event loose coins are present.

It is a further object of the invention to provide a coin wrapper discharge assembly that is fully automatic during normal operation of the coin wrapping apparatus, but which must be manually reset when loose coins have been detected.

The foregoing and other objects and advantages of the invention will appear in the description that follows. In the description, reference is made to the accompanying drawings, which illustrate a preferred embodiment of the invention.

DESCRIPTION OF THE PREFERRED EMBODIMENT

Figure 1:
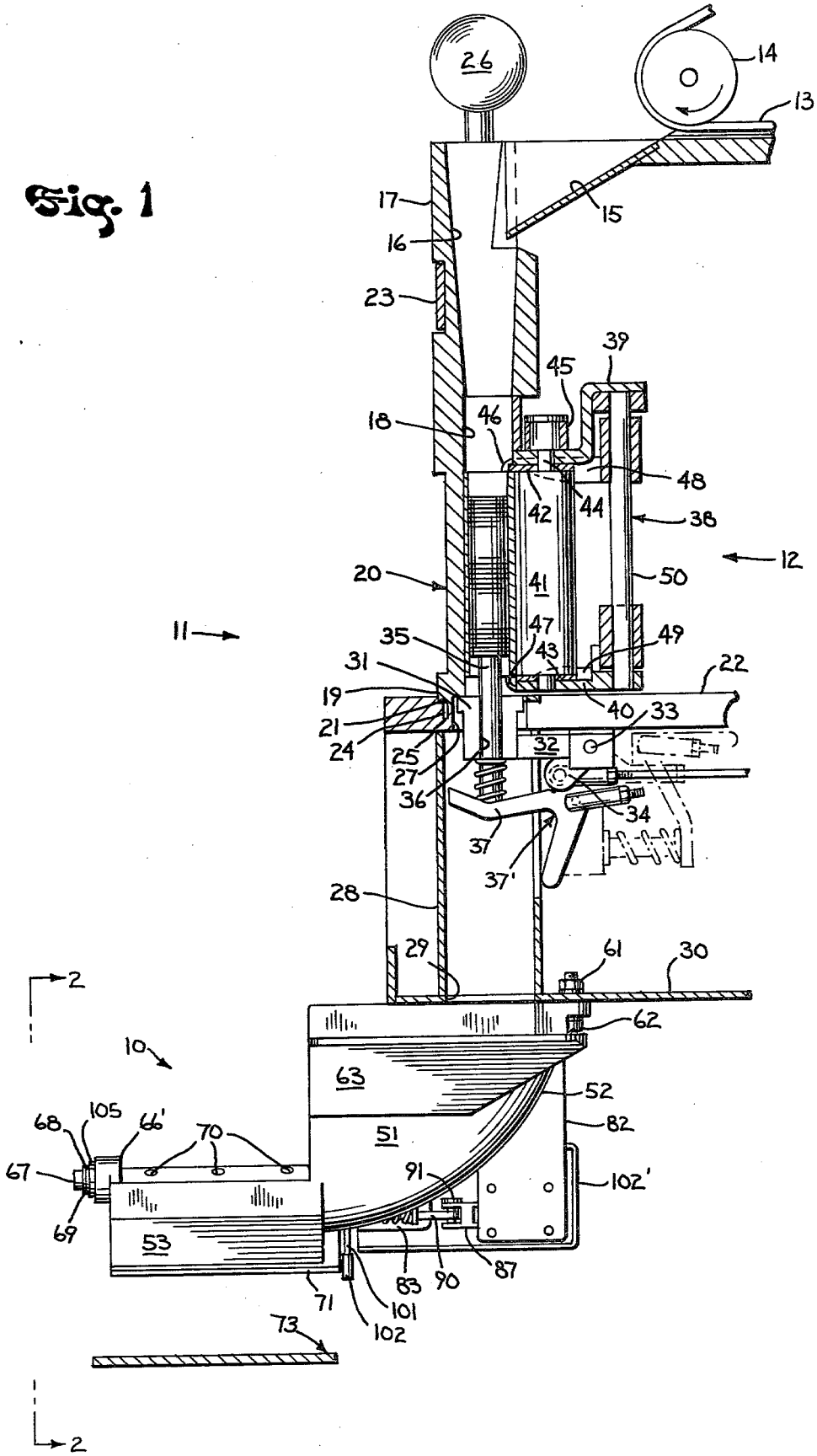
FIG. 1 is a side view in vertical elevation, and partially in section, of a coin wrapper discharge assembly positioned beneath a coin wrapping apparatus in accordance with the invention.

Referring to FIG. 1, there is shown a coin wrapper discharge assembly designated generally by the numeral 10, mounted beneath a coin wrapping apparatus 11. The preferred embodiment of the discharge assembly 10 is adapted for use with a coin wrapping apparatus as described in Bergman et al, U.S. Pat. No. 4,089,151 issued May 16, 1978, for a "Coin Wrapping Machine." The machine described in Bergman et al includes a coin count module (not shown) and a stacking and wrapping apparatus 12. The coin count module is generally known and is of the type illustrated and described in U.S. Pat. No. 3,138,166 issued June 23, 1964 to Arnold R. Buchholz for "Control Mechanism for Coin Counting Machines," and in U.S. Pat. No. 4,089,151 issued to Bergman et al for a "Coin Wrapping Machine." Reference should be had to such patents for details of the construction and operation of the coin count module, and the stacking and wrapping apparatus 12.

Coins leaving the coin count module are ejected by means of a belt 13 and pulley 14 to an inclined packaging chute 15 of the stacking and wrapping apparatus 12. The packaging chute 15 directs the coins to an upper tapered opening 16 of a removable coin tube 17. The coin tube 17 has a lower central bore 18 which is specifically dimensioned to accommodate a single denomination of coin. The coin tube 17 has a generally cylindrical outer surface rising from a cylindrical base 19. Immediately above the base 19, flats are machined in the outer surfaces of the tube 17 to form a generally triangular cross section portion 20 which is necessary for the wrapping and crimping of a stack of coins.

The coin tube 17 is located in place and secured by placing the coin tube base 19 in a shallow counterbore 21 disposed in the upper surface of a main floor plate 22 in the apparatus 11, and by locking a block 23 in place. The coin tube 17 is further located by means of a pin 24 extending from the underside of the base 19 and received in a bore 25 in the floor plate 22. The block 23 is connected by means of a spring loaded rod (not shown) to a large knob 26 which can be grasped by an operator to pull the rod upwardly and release the block 23 for removal of the coin tube 17.

The floor plate 22 has an opening 27 coaxial with the counterbore 21, and in line with the central bore 18 of the coin tube 17. A tube extension 28 surrounds the opening 27 and extends downwardly from the underside of the floor plate 22 to surround an opening 29 in main frame 30 of the coin wrapping apparatus 11. The extension 28 leads to the discharge assembly 10 of the present invention.

The bottom open end of the central bore 18 may be closed by a generally cylindrical coin pad 31 which extends into the floor opening 27, and has its upper surface in the plane of the top surface of the floor plate 22. The coin pad 31 is mounted on the end of an arm 32 which projects through an opening in the extension 28. The arm 32 is mounted on a pivot 33, and a crank lever 34 is secured to the arm 32 and also mounted on the pivot 33. Under the control of a coin pad cam (not shown), the coin pad 31 is movable between its position in which it functions to close the floor opening 27 and a position in which it is swung out of the way and thus removed from the floor opening 27 and out of the path of completed coin rolls falling from the central bore 18 of the coin tube 17. The alternate positions of the coin pad 31 are shown in FIG. 1.

FIG. 1 also shows a rod-like coin stool 35 movable in a central bore 36 in the coin pad 31. The bottom end of the coin stool 35 rests on one leg 37 of the coin stool crank 37'. The positioning of the coin stool crank 37' is under the control of a coin stool cam and a jog cam (not shown). FIG. 1, however, shows the coin stool 35 in its fully extended position lifting a stack of coins in preparation for wrapping and crimping of the coins, and in its retracted position outside the extension 28.

A wrapping and crimping assembly indicated generally by the numeral 38, is also shown in FIG. 1, and is formed of upper and lower plates 39 and 40, respectively. A wrapping roller 41 is mounted in bearings 42 and 43 disposed at the ends of spaced arms projecting outwardly from the upper and lower plates 39 and 40, respectively. Projecting upwardly through the upper bearing 42 is a roller shaft 44 mounting a drive gear 45. The drive gear 45 is driven by a motor, shaft and belt assembly (not shown), and the action of the wrapping roller 41 is controlled by a wrapping roller cam (not shown). Crimping is provided for by upper and lower crimper blades 46 and 47. The crimper blades 46 and 47 extend outwardly from upper and lower cylindrical slides 48 and 49, respectively, which are mounted on a rod 50 extending between the upper and lower plates 39 and 40. The upper and lower crimper blades 46 and 47 are normally urged towards each other, and the reciprocal action of these blades necessary to produce crimping of paper wrapped around a stack of coins is controlled by a crimper cam assembly (not shown).

The coin wrapping apparatus 11 as described to this point can be considered known and understood by those skilled in the art providing an automatic apparatus for stacking and wrapping a predetermined quantity of coins to produce a roll of coins.

Figure 2:
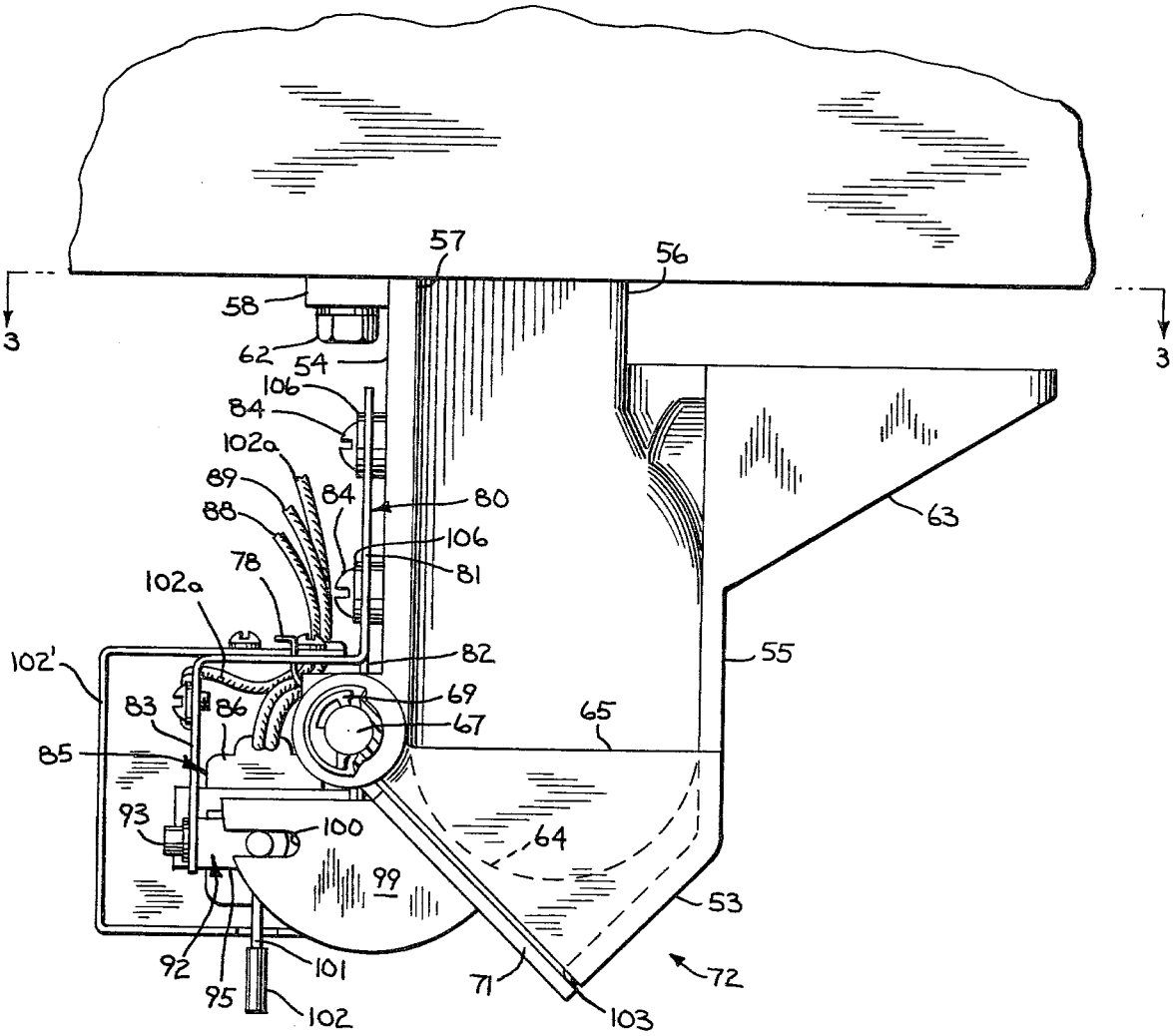
FIG. 2 is a front view in vertical elevation, and partially in section, of the coin wrapper discharge assembly viewed from the plane of the line 2—2 of FIG. 1.
Figure 2:
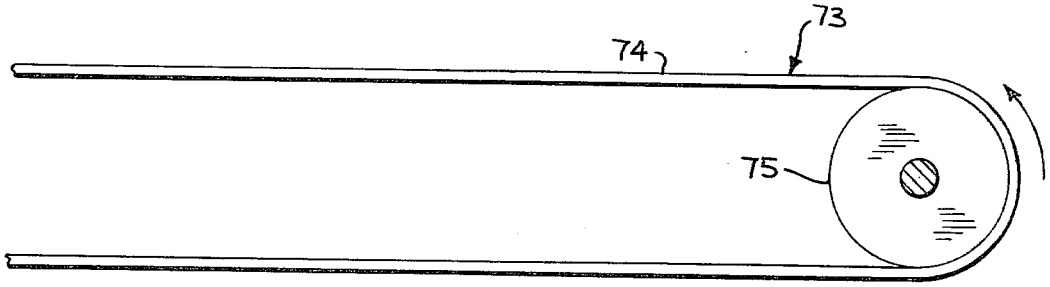
Figure 3:
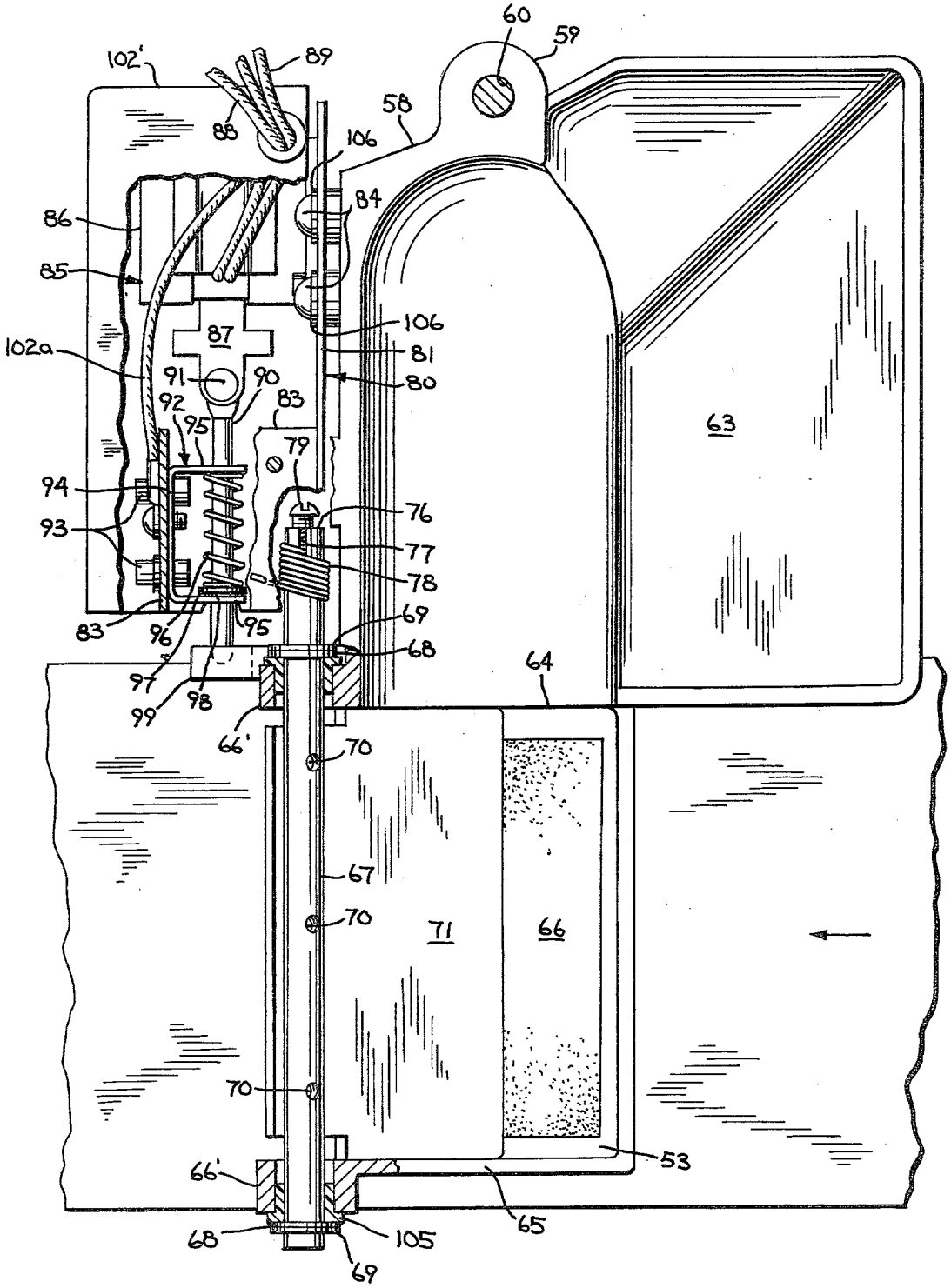
FIG. 3 is a top plan view, and partially in section, of the coin wrapper discharge assembly viewed from the plane of the line 3—3 of FIG. 2.

As a unique and distinct feature, FIGS. 1–3 show a discharge assembly 10 depending from the underside of the main frame 30 of the coin wrapping apparatus 11. The discharge assembly 10 includes a chute 51 comprised of a U-shaped elbow 52 that leads to an inclined floor 53. The elbow 52 has an inner side wall 54, an outer side wall 55 and a rear wall 56 forming its U-shape. The upper end of the elbow 52 has a mouth portion 57 that is open, and is disposed beneath the frame opening 29 in the main frame 30 so as to be in a position to receive coin rolls. A flange 58 is located along the mouth portion 57 of the inner side wall 54 and rear wall 56 of the elbow 52 that has an ear portion 59 with a bolt receiving opening 60 formed therethrough. When the chute 51 is positioned beneath the extension 28, the flange 58 is flush with the underside of the main frame 30, and a nut 61 and bolt 62 secure the discharge assembly 10 to the main frame 30 through the bolt receiving opening 60. The chute 51 also includes an inclined catch plate 63 that is affixed to the outer side wall 55 at the mouth portion 57 of the elbow 52. The catch plate 63 slopes downwardly towards the outer side wall 55, and may be cast as one piece with the elbow 52 or cast separately to be removably mounted on the outer wall 55 depending upon the coin wrapping apparatus being used. The catch plate 63 broadens the effective open area of the mouth portion 57 of the elbow 52 to ensure that the chute 51 catches all coin rolls or loose coins being discharged from the coin wrapping apparatus. Both the inner side wall 54 and outer side wall 55, as well as the rear wall 56 of the elbow 52, are inclined in a dish-like manner such that these walls slope downwardly and forwardly towards a discharge portion 64 of the chute 51.

The inclined floor 53 of the chute 51 is formed from the outer side wall 55 of the elbow 52 and depends therefrom in an inclined manner towards the inner side wall 54 of the chute 51. The inclined floor 53 extends forwardly from the outer side wall 55 of the elbow 52 and is positioned to extend below the discharge portion 64 of the elbow 52. The inclined floor 53 has an electrically conductive surface 66 (paint free) formed on its inner face, the purpose of which will be described hereinafter. As best seen in FIG. 2, the floor 53 also has a front wall 65 extending laterally from its front edge to close off the front portion of the floor 53.

As shown in FIG. 3, both the flange 58 of the elbow 52 and the front wall 65 of the floor 53 have a U-shaped shaft mounting bracket 66' extending integral therefrom which mount and rotatably support a shaft 67. The shaft 67 has a pair of bushings 68 that surround the shaft 67 on the outside of the mounting brackets 66', and a pair of retaining rings 69 that are positioned in circumferential grooves in the shaft 67 outside of the bushings 68 to prevent the shaft 67 from sliding off its mountings. Extending between the inner side wall 54 of the elbow 52 and the front wall 65 of the floor 53, and depending from the shaft 67 by means of rivets 70 is a door 71. The door 71 engages the lower edge of the floor 53 to define a V-shaped trap 72 for catching coin rolls. The door 71 normally closes the opening defined by the inclined floor 53, and discharge portion 64 of the elbow 52, and the front wall 65. However, it is rotatable to an open position when it is desired to allow a coin roll to fall through the trap 72 onto a conveyor 73. The conveyor 73 includes a belt 74 and pulley 75 for transporting coin rolls to a collection point for packaging.

The rearward section of the shaft 67 has a longitudinal bore 76 with an axial slot 77 formed therein. The slot 77 receives one end of a door spring 78 which is circumferentially wound around the shaft 67. A screw 79 threaded into the longitudinal bore 76 holds the door spring 78 in place. The other end of the door spring 78 extends through an opening in a solenoid bracket 80 so that the spring 78 is tensioned whenever the door 71 is rotated to open the trap 72. The solenoid bracket 80 has a base plate 81, a solenoid supporting plate 82 extending downwardly from the rearward section of the base plate 81, and a latch pin plate 83 spaced forwardly of the solenoid supporting plate 82 on the base plate 81. The latch pin plate 83 first extends outwardly from the base plate 81, and then downwardly to form an L-shaped member. The base plate 81 of the solenoid bracket 80 is secured to the inner side wall 54 of the elbow 52 by a pair of bolts 84 extending through the plate 81 and into the inner side wall 54.

As seen best in FIG. 3, there is mounted on the solenoid supporting plate 82 a solenoid valve 85 which is operative between a pair of positions, one position allowing the door 71 to open, and the other position securing the door 71 closed. The solenoid valve 85 includes a body portion 86 which contains an electrical coil (not shown) and a solenoid plunger 87. The solenoid plunger 87 has a bifurcated end and is mounted for axial movement within the body portion 86 to move inwardly and outwardly when energized and de-energized. A pair of leads 88 and 89 are connected to the coil, wherein one lead 88 is joined to a power source through a cam control switch (not shown) and the other lead 89 is joined to ground. The electric coil generates a magnetic field when an a-c voltage is applied to the lead 88, which causes the solenoid plunger 87 to shift from the deenergized extended position to an energized retracted position. The leads 88 and 89 are connected into the cam control circuit of the coin wrapping apparatus in such a manner that the solenoid valve 85 is energized whenever a new stack of coins is being wrapped.

A latching pin 90 is connected to the solenoid plunger 87 in coaxial alignment therewith by a link pin 91 extending through the bifurcated end of the solenoid plunger 87. The latching pin 90 is guided in its axial movement by a guide bracket 92 which is secured to the inner surface of the downwardly extending portion of the latch pin plate 83 by bolts 93. The guide bracket 92 is channel shaped having a web portion 94 and side flanges 95 with the bolts 93 extending through the web portion 94, and the latching pin 90 extending through the side flanges 95 of the guide bracket 92. The latching pin 90 has a coil spring 96 wound around its circumference and disposed between the side flanges 95. The coil spring 96 bears against a washer 97, and is secured between the side flanges 95 of the guide bracket 92 by a retainer ring 98 mounted in a circular groove formed in the latching pin 90. The latching pin 90 extends through the guide bracket 92 to a door latching block 99. The door latching block 99 is secured to the outer surface of the door 71 for movement therewith. The latching block 99 is in the form of a wedge shaped plate having a slot 100 formed at its circumference that extends inwardly parallel to the upper edge of the block 99. A roll pin 101 having a roll pin handle 102 at its outer extremity is secured to the latching pin 90 and projects downwardly therefrom. The roll pin 101 and handle 102 are disposed between the guide bracket 92 and the latching block 99 for easy access by an operator. The door latching pin 90 extends into the slot 100 when the solenoid 85 is de-energized to secure the door 71 and is retracted from the slot 100 when the solenoid 85 is energized to release the door 71. A removable side cover 102' encloses the solenoid 85 and guide bracket 92 to protect these elements.

If the coin wrapping apparatus 11 should malfunction and form either no roll or an incomplete roll of coins, a means for detecting the resultant loose coins is provided by an electrical circuit set up between the chute 51 and the door 71. The chute 51 is connected to ground and the door 71 is connected to a d-c sensing circuit through the spring 78 and by a wire **102*a* secured to the solenoid bracket 80. The door 71 is insulated from the inclined floor 53, which in the preferred form of the invention is cast integral with the elbow 52, by a pair of nylon insulating rivets 103 which are located on the lower edge of the inclined floor 53. The door 71 is further insulated from the elbow 52 and floor 53 by a pair of T-shaped nylon shaft insulators 105 that slide over the ends of the shaft 67 until positioned between the shaft 67 and the mounting brackets 66'. The solenoid bracket 80 is also insulated from the chute 51 by a pair of nylon solenoid bracket insulators 106 inserted between the bolts 84 and their corresponding washers which mount the solenoid bracket 80 to the inner side wall 54 of the elbow 52. Thus, the floor 53 and door 71 not only form a trap 72** for coin rolls and loose coins, but also form a pair of electrical contacts that complete an electrical circuit when loose coins bridge the V formed by the floor 53 and door 71. The surface 66 of the inclined floor 53 is roughened to provide better contact surface area for completion of the electrical circuit.

Figure 4:
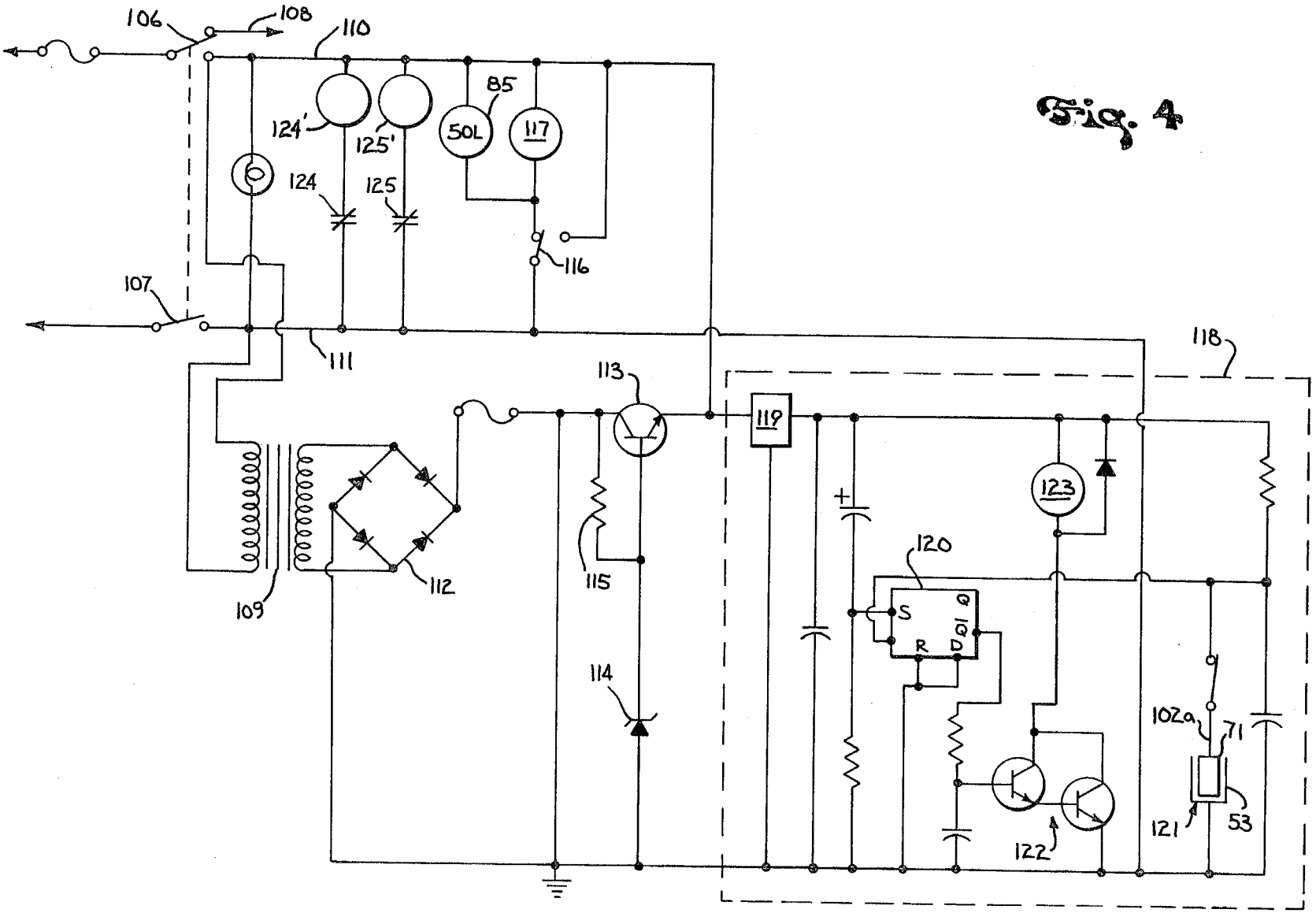
FIG. 4 is a schematic circuit diagram of the control circuit for the discharge assembly.

The electrical control system for the discharge assembly 10, and part of the preferred control system for a coin wrapping apparatus is shown in schematic form in FIG. 4. The present invention in its preferred form is adapted for use with a coin wrapping apparatus as disclosed in Bergman et al U.S. Pat. No. 4,089,151, and reference should be made to such patent for the complete details of the electrical control system for the coin wrapping apparatus 11.

An a-c power source leads to one side of a pair of contacts 106 and 107 of a main power switch. The contact 107 is normally open and the contact 106 normally connects to a secondary power line 108 whose function is to provide power during a service or maintenance condition for the coin wrapping apparatus. When the main power switch is actuated, the a-c section of the control is energized. At the same time a d-c portion of the control is energized. The d-c portion is powered by a transformer 109 connected across the main power lines 110 and 111 and which connects to a bridge circuit 112 the output of which is controlled by a series regulator in the form of a power transistor 113, diode 114 and resistor 115. Thus, whenever the main power switch is actuated, both the a-c and d-c portions of the control are energized.

A cam shaft (not shown) that carries a plurality of cams rotates and controls the positions of the coin pad 31, coin stool 35, wrapping roller 41, and crimper blades 46 and 47 to wrap a stack of coins. After the cam shaft has rotated about 40°, a paper feed switch 116 will be actuated to the position shown in FIG. 4 to energize the paper feed motor 117 and the solenoid 85. Paper for wrapping will be driven by the paper feed motor 117 until it completely encircles a stack of coins and the paper feed switch 116 is switched to its alternate position. At the same time, the motor 117 is energized, the solenoid 85 will be energized to retract the latching pin 90 and release the door 71. When the paper feed switch 116 is de-energized due to the completion of the wrapping operation, the plunger 87 and latch pin 90 are extended by the solenoid 85 to re-engage and hold the door 71.

The loose coin circuit, indicated generally by the numeral 118, provides a control for the discharge assembly 10 allowing it to catch loose coins from an improper wrap. The circuit is part of the d-c control circuit and is stepped down in voltage by means of a regulator 119. The loose coin circuit 118 includes a wired D-type latching flip-flop 120 which is set whenever the main power switch is actuated. The flip-flop 120 is clocked to change its state by the completion of a circuit through the loose coin switch 121 formed by the door 71 and the floor 53. When loose coins bridge the V formed by the door 71 and the floor 53, the loose coin switch 121 will be closed. Closing of the loose coin switch 121 will cause the flip-flop 120 to change its state to turn on a Darlington circuit 122 thereby completing the circuit for energization of the loose coin relay 123.

Energization of the loose coin relay 123 will open the normally closed relay contacts 124 and 125 thereby preventing the completion of circuits for the relay 124' of the cam drive mechanism and the relay 125' of the coin feed mechanism of the coin wrapping apparatus. Since these mechanisms cannot be energized it will not be possible to continue the wrapping of rolls of coins. It is necessary for an operator to turn the main power switch off and then determine the cause of the problem which resulted in loose coins in the trap 72. The loose coins may be removed by the operator from the trap 72 by simply grasping the roll pin 101 by its handle 102 and sliding the latching pin 90 and plunger 87 axially towards the solenoid 85. This disengages the latching pin 90 from the slot 100 in the block 99, and the loose coins will then fall from the trap 72. Only by turning off the main power switch will the flip-flop 120 be reset upon the subsequent actuation of the main power switch. The resetting of the flip-flop 120 will remove the circuit for energizing the loose coin relay 123 and permit energization of the cam drive mechanism and the coin feed mechanism for subsequent operation of the machine.

Thus, under normal operation of a coin wrapping machine, the mouth portion 57 of the chute 51 accepts a downwardly falling wrapped roll of coins. The walls of the chute 51 direct the coin roll laterally of its original downward motion until it falls into the V-shaped trap 72 formed by the floor 53 and door 71. At this point in time, the coin roll does not fall through the trap 72 since the door 71 is being held in its closed position by the solenoid 85 by means of the latching pin 90 and latching block 99.

At substantially the same time as the first coin roll is being held by the trap 72, another stack of coins are being prepared for wrapping by the coin wrapping apparatus 11. The functions of the wrapping apparatus 11 are controlled by a plurality of cams on a cam shaft such that at a point in time after the first coin roll is caught by the trap 72, a paper feed switch 116 will be activated to provide paper for wrapping the stack of coins now formed in the wrapping apparatus 11. When the paper feed switch 116 is activated, the solenoid 85 is also energized to retract the latching pin 90 and release the door 71. Due to the weight of the coin roll, the door 71 is pivoted clockwise open and the coin roll falls through to a conveyor 73 which removes it for packaging. The rotation of the door 71 also causes the shaft 67 to rotate and tension the door spring 78. Thus, after the coin roll falls through the trap 72, the spring 78 pivots the shaft 67 and door 71 counterclockwise until the door 71 is once again engaged with the floor 53 to form a V-shaped trap. When the stack of coins in the wrapping apparatus 11 have been wrapped by a sufficient amount of paper, the paper feed switch 116 is deactivated which results in the solenoid 85 being de-energized. The deactuation of switch 116 occurs after the coin roll has fallen through to the conveyor 73, and when it occurs the solenoid 85 is de-energized allowing spring 96 to extend the latching pin 90 into the slot 100 of the latching block 99 to once again securely hold the door 71 in its closed position. This cycle then repeats itself.

If the coin wrapping apparatus 11 malfunctions and forms either no roll or an incomplete roll of coins, loose coins will be discharged into the chute 51 and directed to the trap 72. When this occurs, the electrical contacts formed by the floor 53 and door 71 of the trap 72 are bridged by the coins to complete an electrical circuit 118 to disable the cam drive and coin feed mechanism of the coin wrapping apparatus. This prevents any further wrapping of coins until an operator determines the cause of the problem.

A discharge assembly 10 has been shown and described for use with a coin wrapping apparatus that catches and momentarily stops a wrapped roll of coins to change its direction, and has a mechanism for the detection of loose coins. In this structure, coin rolls fall downwardly through a tube extension 28 of a coin wrapping apparatus to the mouth portion 57 of a chute 51. The chute 51 has walls that slope downwardly and forwardly to direct a coin roll laterally of its original downward direction into a V-shaped trap 72 formed by an inclined floor 53 and a door 71. A solenoid 85 holds the door 71 in its normally closed position until actuated by a paper feed mechanism in the coin wrapping machine to release the door 71. In addition, the door 71 is connected to a d-c sensor circuit and is electrically insulated from the floor 53, which is connected to ground, to provide a pair of electrical contacts. When loose coins enter the trap 72, they will bridge the contacts formed by the door 71 and floor 53 to complete an electric circuit that disables the coin wrapping apparatus.

We claim:

1. In a coin wrapping apparatus for wrapping a stack of coins into a coin roll, a discharge assembly comprising:

a chute disposed beneath said coin wrapping apparatus adapted to accept a coin roll;

a swingable door normally closing said chute to define a trap for said coin roll;

release means responsive to the wrapping of a stack of coins for releasably holding said door in its closed position; and sensing means for detecting loose coins in said trap.

2. A discharge assembly as described in claim 1, wherein:

said chute comprises a U-shaped elbow having a mouth portion and a discharge portion, said elbow having side walls that slope downwardly and forwardly towards said discharge portion.

3. A discharge assembly as described in claim 2, wherein:

said elbow includes a catch plate mounted at the mouth portion of said elbow and inclined towards said mouth portion.

4. A discharge assembly as described in claim 1, wherein said sensing means includes:

an inclined floor disposed in front of said chute that intersects with said door to form said trap; and insulating means for electrically insulating said door from said floor and chute to define a pair of switch contacts that are bridged by loose coins within said trap.

5. In a coin wrapping apparatus for wrapping a stack of coins into a coin roll, a discharge assembly comprising:

a chute disposed beneath said coin wrapping apparatus having a U-shaped elbow with a mouth portion and a discharge portion, and side walls that slope downwardly and forwardly toward said discharge portion;

a swingable door normally closing said chute at said discharge portion in an inclined plane to define a trap for said coin roll;

release means responsive to the wrapping of a stack of coins for releasably holding said door in its closed position;

an inclined floor disposed in front of said chute that intersects with said door to form said trap; and insulating means for electrically insulating said door from said chute to define a pair of switch contacts that are bridged by loose coins within said trap.

6. A discharge assembly as described in claim 5, wherein said release means includes:

a latching block mounted on said door for movement therewith; and a solenoid mounted on a side wall of said chute having plunger means engaged with said block that is retracted from said block upon the wrapping of a stack of coins and is extended to re-engage said block when wrapping is completed.

7. A discharge assembly as described in claim 6, wherein said plunger means includes:

a plunger mounted for axial movement within said solenoid;

a latching pin secured to said plunger and extending coaxially from said plunger for engagement with said latching block; and a channel-shaped latching pin guide that supports and guides said latching pin.

8. In a coin wrapping apparatus for wrapping a stack of coins into a coin roll, a discharge assembly comprising:

a chute disposed beneath said coin wrapping apparatus comprising a U-shaped elbow having a mouth portion and a discharge portion;

said elbow having side walls that slope downwardly and forwardly towards the discharge portion of said chute;

an inclined floor disposed in front of the discharge portion of said elbow;

a swingable door normally closing said chute by engaging said inclined floor to form a V-shaped trap for said coin roll;

a latching block mounted on said door for movement therewith having a slot formed therein;

a solenoid having plunger means engaged with said block that is retracted from the slot in said block upon the wrapping of a stack of coins and is extended into said slot when wrapping is completed; and said door being electrically insulated from said chute to define a pair of switch contacts that are bridged by loose coins within said trap.

9. A discharge assembly as defined in claim 8, wherein:

said coin wrapping apparatus is disabled upon the closing of the switch defined by said door and floor.

* * * * *